United States Patent [19]

Stephens

[11] Patent Number: 4,751,353

[45] Date of Patent: Jun. 14, 1988

[54] DOLL OR THE LIKE WITH POSITION AND MOTION SENSING SWITCH

[75] Inventor: Donald H. Stephens, East Lyme, Conn.

[73] Assignee: Coleco Industries, Inc., West Hartford, Conn.

[21] Appl. No.: 11,836

[22] Filed: Feb. 6, 1987

[51] Int. Cl.[4] ..... H01H 1/20

[52] U.S. Cl. ..... 200/277; 200/61.52; 200/153 A

[58] Field of Search ..... 200/153 A, 61.5240, 200/187, 188, 277, 220, 223, 224, 226–229

[56] References Cited

U.S. PATENT DOCUMENTS

| | | | |
|---|---|---|---|
| 3,263,033 | 7/1966 | Metzger | 200/8 R |
| 3,311,717 | 3/1967 | Lace | 200/8 R |
| 3,481,070 | 12/1969 | Baulard-Cogan | 446/198 |
| 3,520,200 | 7/1970 | Rodgers | 73/517 R |
| 3,553,399 | 1/1971 | Osen | 200/61.45 R |
| 3,599,745 | 8/1971 | Hughes | 200/61.52 |
| 3,619,524 | 11/1971 | Gillund | 200/61.45 M |
| 3,752,945 | 8/1973 | Achterberg | 200/277 |
| 3,935,701 | 2/1976 | Yamauchi et al. | 200/61.52 |
| 4,001,185 | 1/1977 | Mitsui et al. | 200/277 |
| 4,022,998 | 5/1977 | Föhl | 200/61.45 R |
| 4,450,326 | 5/1984 | Ledger | 200/61.45 M |
| 4,503,299 | 3/1985 | Henrard et al. | 200/61.52 |

FOREIGN PATENT DOCUMENTS

| | | | |
|---|---|---|---|
| 2709397 | 4/1978 | Fed. Rep. of Germany . | |
| 378067 | 9/1907 | France | 200/220 |
| 2428316 | 2/1980 | France | 200/220 |

*Primary Examiner*—Renee S. Luebke

[57] ABSTRACT

A device which senses position through a conductive ball which may be seated on one of a plurality of pairs of contacts in a cavity within a housing in accordance with the angular position of the sensor and which also senses motion through movement of the ball making and breaking contacts as the device is subjected to movement.

8 Claims, 2 Drawing Sheets

DOLL OR THE LIKE WITH POSITION AND MOTION SENSING SWITCH

CROSS-REFERENCE TO RELATED APPLICATION

Copending application Ser. No. 07/011,832 filed Feb. 6, 1987 and assigned to the same assignee as this application, discloses a device which senses motion only.

FIELD OF THE INVENTION

This invention relates to a device which will sense motion and which will also sense position.

BACKGROUND OF THE INVENTION

Devices which will sense positions of a doll or toy are known and exemplified by U.S. Pat. No. 3,481,070 which uses multiple position sensors. In this patent, there is disclosed a doll having a conductive ball in its abdomen which may make various switch contacts to indicate the position of the doll.

Also devices which sense motion are by virtue of a conductive ball making and breaking contacts are well known as exemplified by U.S. Pat. Nos. 3,520,200, 4,318,245, 3,752,945 and German Auslegeschrift No. 2,709,397.

While the prior art shows position sensing devices and also motion sensing devices, there is no disclosure of a simplified device for sensing positional attitude of an object such as a doll and the motion to which the doll may be subjected.

Today's toys are becoming quite sophisticated and there is a desire for toys and dolls to interact with the owner. In dolls with synthesized speech, there may be a speech routine which requires the logic system of the doll to know the position of the doll, and also in some circumstances, to know if the doll is being moved. For example, it may be desired to have a routine where the doll makes a request that the owner bounce the doll on the owner's knee. When the owner makes such bounce, there must be a device to sense the motion of the doll that may respond to the owner. Additionally, in another speech routine, the doll may ask to be put to sleep, in which case, the owner would lay the doll on its back. Accordingly, there is a requirement that the position of the doll be sensed so that it may respond with a suitable phrase, such as, "Thank you" or "Good Night". There may be additional routines in which the doll requests the owner to place it on its stomach or on its side or upright, in which case, the doll would make an intelligible response when the owner moved the doll to the requested position.

Accordingly, there is a need for an inexpensive, reliable device which will sense the coordinate position of a doll and will also indicate if the doll is being moved.

The present invention provides a new and improved contact make and break device which will sense motion and which also defines four independent seats for a conductive ball to indicate four coordinately different positions.

SUMMARY OF THE INVENTION

Briefly stated, the invention in one form thereof comprises a housing and pin contact arrangement therein together with a conductive movable ball such that a plurality of distinct contact pin pairs are defined and the ball may seat on any one of the contact pairs and effect closure of electrical circuits to indicate the positional orientation of the sensor (up to four coordinate directions). More specifically, the invention comprises a housing member defining an internal cavity with a conductive ball therein and a plurality of independent contacts in the housing positioned to define four coordinately related seats for the ball, each seat defined by a distinct two of the contacts, one of the contacts is configured to cooperate with three of the other contacts, and the distinct two of contacts are spaced by a dimension less than the diameter of said ball and means are provided on the housing within the cavity for preventing free rolling movement of said ball from a position on a distinct two of the contacts unless the angular position of said sensor is changed, or the sensor is subjected to motion.

The one of the contacts and another one of the contacts are adapted to be connected to a first electrical potential while said one of said contacts and said another of the contacts are not a distinct two of said contacts, the remainder of the contacts are adapted to be connected at another electrical potential.

If the sensor is subjected to vibration or movement, the ball will move within the housing and make and break many of the distinct contacts. The frequency of making and breaking such contacts per unit time will indicate the severity of the motion or vibration to which the sensor is subjected.

DETAILED DESCRIPTION OF THE ILLUSTRATED EMBODIMENT

Figure 1:
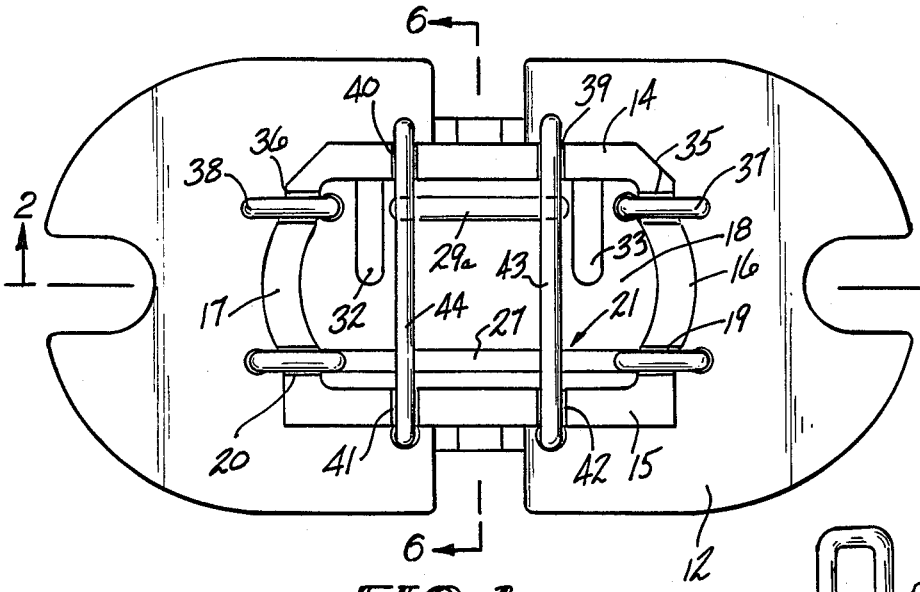
FIG. 1 is a top plan view of a sensor embodying the invention with the cap removed and showing a base member with contacts seated herein.
Figure 2:
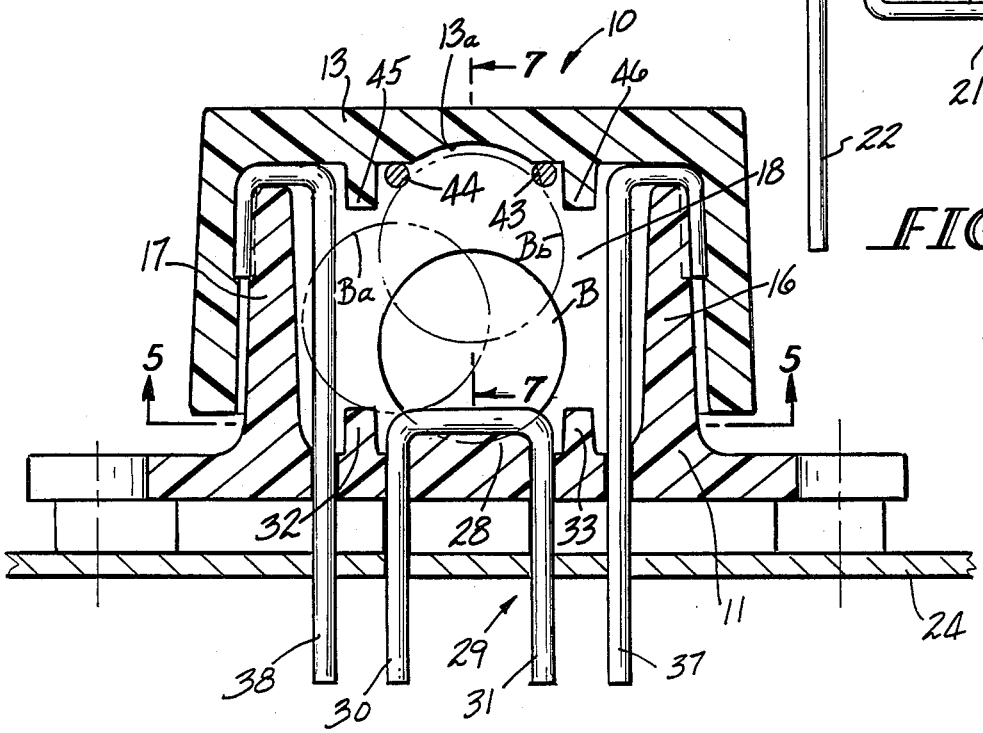
FIG. 2 is a sectional view seen in the plane of lines 2—2 of FIG. 1 with the cap thereon.

A sensor 10 embodying the invention is exemplified in FIGS. 1 and 2, and comprises a base member 11 having a lower mounting flange 12 which receives a closure member 13 which locks a plurality of contact members to the sensor. Member 11 has upstanding integrally joined sidewalls 14, 15 and end walls 16, 17. The side and end walls together with the bottom of member 11 define a cavity 18. Upper edges of the side and end walls are notched to receive contact pins.

As will be hereinafter described, contact pins are arranged in distinct twos to provide four seats for a conductive ball B. Each seating of the ball B will indicate a coordinate position of the sensor. Cooperating with each contact seat are restraining means in the form of ribs integral with the base 11 or cap 13 which prevent free rolling movement of the ball away from a seat once the ball is seated.

Figure 4:
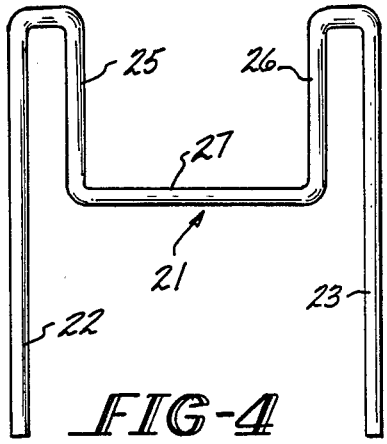

Wall 16 at the upper edge is notched at 19 and wall 17 is notched at 20 to receive a pin 21 of general M shape, as shown in FIG. 4. Pin 21 has legs 22 and 23 extending through base member 11 and into a circuit board indicated by the reference numeral 24 in FIG. 2. Contact 21 has portions 25 and 26 which are vertical within cavity 18, as illustrated. A small rib 28 projects from base member 11 within cavity 18 and provides support and positioning for a U shaped contact 29 having legs 30 and 31 extending through base member 11 and circuit board 24. The bight portion 29*a* of contact 29 and the bight portion 27 of contact 21 form a seat for a conductively coated ball B. Rib members 32 and 33 are formed integrally with base member 11 at the bottom of cavity 18 and extend slightly above rib 28. These ribs will prevent free rolling motion of ball B from the position shown in full line in FIG. 2.

U shaped contact 29 and M shape contact 21 are connected by ball B as shown in FIG. 2. When the ball is in the full line position the ribs 32 and 33 being higher than rib 28, define a seat for the ball when the sensor is in the position shown in FIG. 2.

End walls 16 and 17 also have defined therein notches 35 and 36, respectively, which receive the ends of J shape contacts 37 and 38, respectfully.

The end wall 16 and 17 define acuately formed pockets inside the cavity 18 so as to provide a space for the ball to seat on contacts 21 and 38 or 21 and 37. If the sensor 10 were rotated ninety degrees counterclockwise from the position shown in FIG. 2, in the plane of the paper, the ball would assume the position Ba, as shown in FIG. 2 and extend into the arcuate pocket defined by end wall 17.

Figure 3:
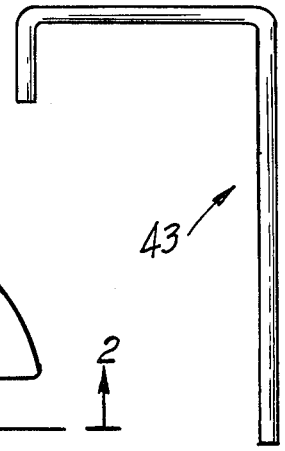
FIGS. 3 and 4 are elevation views of contacts used in the sensor.

Sidewall 14 has notches 39 and 40 and sidewall 15 has notches 41 and 42. Notches 39 and 42 receive an L shaped contact 43, as shown in FIG. 3. Notches 40 and 41 receive another L shaped contact 44, identical to contact 43.

The contacts 21, 37, 38, 43 and 44 have portions overlying the outside of the side and end walls and are locked in position by cap member 13. Member 13 defines an arcuate pocket for the ball when it is in position Bb. Such position would occur if the sensor as shown in FIG. 2 were inverted.

Figure 5:
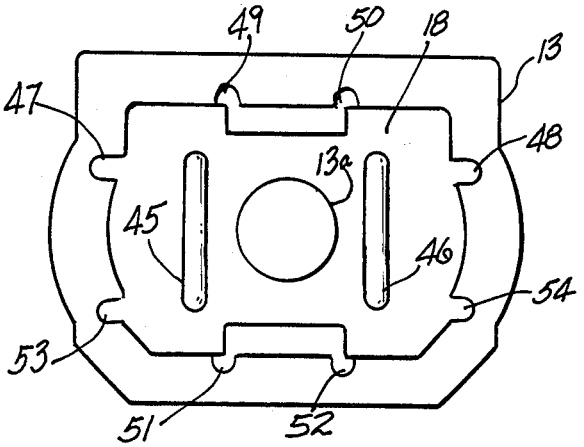
FIG. 5 is a view of the inside of the cap only as seen in the plane of lines 5—5 of FIG. 2.

On either side of pocket 13*a* are small ribs 45 and 46, as more clearly shown in FIG. 5. The ribs 45 and 46 extend substantially half way across the inner roof of cap member 13.

Defined in cap member 13 are recesses 47 and 48 for receiving the legs 22 and 23, respectively, of contact member 21. Recesses 49, 50 51 and 52 receive the L shaped contact pins 43 and 44. Recesses 53 and 54 receive J shaped contacts 38 and 37 respectively.

Figure 6:
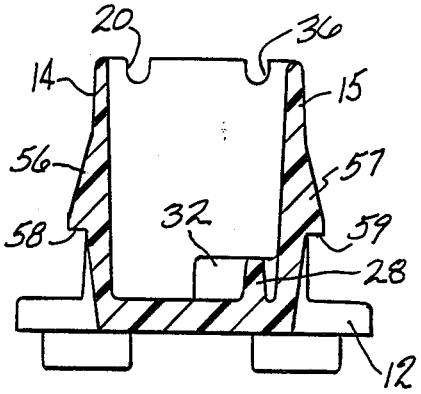
FIG. 6 is a sectional view seen in the plane of lines 6—6 of FIG. 1 with contacts removed.

Reference is now made to FIG. 6 which is a sectional view seen in the plane of lines 6—6 of FIG. 1 with the contacts removed. On each side of body member 11 are detents 56 and 57 which taper downwardly from the side walls 14 and 15. Detents 56 and 57 terminate in lower flats or surfaces 58 and 59, respectively, essentially perpendicular to walls 14 and 15.

Figure 7:
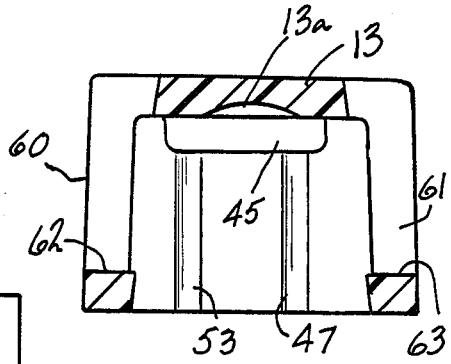
FIG. 7 is a sectional view seen in the plane of lines 7—7 of FIG. 2 of the cap only.

Reference is now made to FIG. 7. Cap member 13 has openings 60 and 61 defined therein which will receive the detents 56 and 57. The cap member is assembled and the surfaces 62 and 63 will latch beneath the flats 58 and 59 of the detents 56 and 57.

Both the base member and the cap member are made of an essentially rigid plastic material. However, such plastic will be capable of sufficient elastic deformation so that the cap member may be forced over the tapered walls of the detents 56 and 57, and when the surfaces 62 and 63 are clear of the lower ends of the detents, the cap will snap back into position with the detents locking the cap on.

Referring now to FIG. 2, when the sensor is in the position shown, the ball B will be in the full line position and the ribs 32 and 33 upstanding from the floor of cavity 18 will prevent any free rolling movement of the ball from the position shown. At such time, ball B rests on U-shaped contact 29 and M-shaped contact 21. If the sensor as shown in FIG. 2 should be inverted one hundred eighty degrees, the ball will be in the position Bb and will make contact with the two L shaped contacts 43 and 44. The ribs 45 and 46 will then prevent any free rolling movement of the ball from the position Bb.

If the sensor should be rotated ninety degrees counterclockwise, from the position shown in FIG. 2, the ball will assume the position of Ba and will make contact with one of the J contacts 38 and leg 22 of contact 21. In this position, ribs 32 and 45 prevent free rolling motion of ball B to another contact. If the sensor should be rotated ninety degrees clockwise from the position shown in FIG. 2, the ball would assume a position in contact with leg 23 of contact 21 and the other J contact 43. In such a position, ribs 33 and 46 would prevent free rolling movement of ball B from contacts 21 and 37.

Contact 21 and one of the contacts 43 are adapted to be connected to one potential such as ground which the other contacts are connected to another potential.

Figure 8:
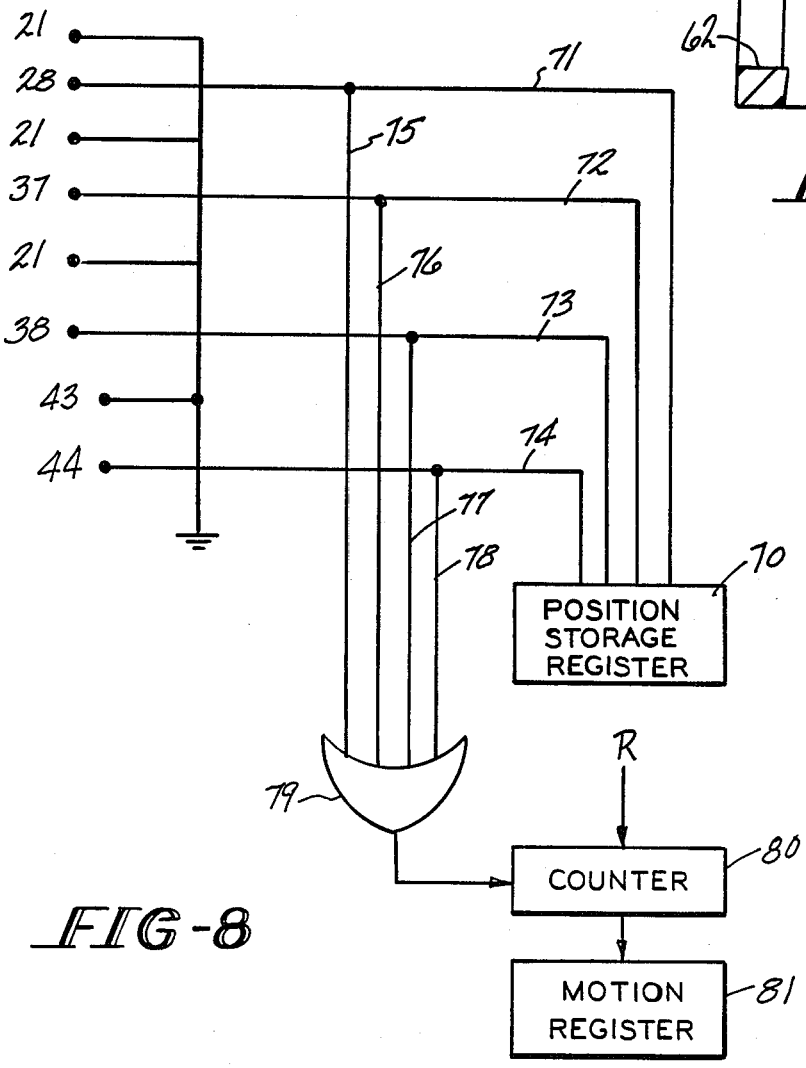
FIG. 8 is a schematic diagram illustrating utilization of a device embodying the invention.

FIG. 8 schematically shows one technique of electrically connecting the sensor. In FIG. 8, the contacts are shown in distinct pairs of two, although the contact 21 is common to three pairs of contacts. Contacts 21 and 43 and shown as connected to ground. Contacts 28, 37, 38 and 44 are connected to a position storage register 70 over lines 71, 72, 73 and 74 respectively. Register 70 may comprise four latches, each of which corresponds to a definite position of ball B, and will be set when the ball is in the corresponding position.

To sense motion, contacts 28, 37, 38 and 44 are applied over lines 75, 76, 77 and 78 respectively to an OR gate 79. If the snesor is subject to shaking, the ball B will override the restraining ribs and make and break a plurality of contacts, thus producing pulse like signals which are counted by a binary counter 80. Counter is periodically reset by a reset signal R and the numerical count is dumped to a motion register 81 which may be sampled to determine the severity of the motion, i.e. the number of contact make and breaks per unit time.

The ball is dimensioned to seat on one of a distinct two contacts. For example, the ball may be 0.250 inches in diameter and the contacts are 0.030 inches in diameter, and a distinct two of said contacts are spaced apart 0.200 inches. This will permit the ball to rest partly below the seating contacts, and the adjacent ribs will prevent electrical contact of the ball with any of the non-seating contacts.

It may thus be seen that the objects of the invention set forth, as well as those made apparent from the foregoing description, are efficiently attained. While preferred embodiments of the invention has been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A sensor for sensing angular positions of an object and motion of the object, comprising a housing member defining an internal cavity; a conductive ball in said cavity, said ball being generally spherical and having a diameter smaller than the transverse dimensions of said cavity; a plurality of independent contacts spaced apart in said housing and positioned to define four coordinately related seats within said cavity at a multiplicity of angularly spaced positions about said cavity and each defined by a distinct cooperating pair of said contacts, a first one of said contacts being disposed and configured to cooperate with each of a plurality of other contacts to provide a plurality of distinct cooperating pairs of contacts, a second one of said contacts not comprising one of said distinct cooperating pairs cooperating with still another one of said contacts to provide another distinct cooperating pair of contacts, said distinct cooperating pairs of contacts being spaced apart a distance less than the diameter of said ball to provide said seats for said ball, said ball making an electrical connection between the cooperating pair of contacts upon which said ball is seated in a given angular position of said sensor; means on said housing extending into said cavity for preventing free rolling movement of said ball from a position seated on a distinct cooperating pair of said contacts unless the angular position of said sensor is changed or said sensor is subjected to motion, said first one of said contacts and said second one of said contacts being adapted to be connected to a first electrical potential, said first one of said contacts and said said second one of said contacts not comprising a cooperating pair of said contacts, said plurality of other and said still another contacts being adapted to be at another electrical potential, whereby, when said sensor is shaken or changed to a different angular position, said ball may make and break the electrical connection between said first one of said contacts or said second one of said contacts and cooperating contact defining a cooperating pair.

2. The sensor of claim 1, wherein said housing comprises a base member with side and end walls defining said cavity and a cap member closing said cavity, at least some of said contacts having portions overlying an upper edge of said walls and extending along the outside of said walls of said base member, said cap member having recesses defined therein and receiving said contacts, and means on said base member and said cap for locking said cap to said base member.

3. The sensor of claim 1, wherein said first one of said contacts has a pair of spaced apart legs which extend through said base member and a depressed intermediate portion, one of said other contacts being of inverted U shape and having a bight portion, said bight portion and said depressed portion defining a seat for said ball, said legs of said first one of said contacts partially defining two other seats for said ball.

4. The sensor of claim 1, wherein said first one of said contacts is common to three of said distinct pairs of contacts.

5. The sensor of claim 1, wherein the contacts of each of said distinct pairs of contacts have spaced apart parallel extending portions defining a seat for said ball.

6. A sensor for sensing angular positions of an object and motion of the object, comprising a housing member defining an internal cavity a conductive ball in said cavity, said ball being generally spherical and having a diameter smaller than the transverse dimensions of said cavity a plurality of independent contacts spaced apart in said housing and positioned to define four coordinately related seats within said cavity at a multiplicity of angularly spaced positions about said cavity and each defined by a distinct cooperating pair of said contacts, said distinct cooperating pairs of contacts being spaced a distance less than the diameter of said ball to provide said seats for said ball, said ball making an electrical connection between the cooperating pairs of contacts upon which said ball is seated in a given angular position of said sensor means on said housing extending into said cavity for preventing free rolling movement of said ball from a position on a distinct cooperating pair of said contacts unless the angular position of said sensor is changed or said sensor is subjected to motion, one of said contacts of each distinct pair being adapted to be connected to a first electrical potential, others of said contacts being adapted to be at another electrical potential, said housing being comprised of a base member defined by side and end walls defining said cavity and a cap member closing said cavity, at least some of said contacts having portions overlying an edge of said base member walls and said cap member having recesses seating said contacts, and means securing said cap member to said base member to secure said contacts in assembly therewithin.

7. The sensor of claim 6, wherein one of said contacts is common to three of said distinct pairs of contacts.

8. The sensor of claim 6, wherein each of the contacts in each of the pairs of contacts have spaced apart parallel portions defining the seat for said ball.

* * * * *